US007156147B1

(12) United States Patent
Wood et al.

(10) Patent No.: US 7,156,147 B1
(45) Date of Patent: Jan. 2, 2007

(54) APPARATUS FOR STEERING CASTING BELTS OF CONTINUOUS METAL-CASTING MACHINES EQUIPPED WITH NON-ROTATING, LEVITATING, SEMI-CYLINDRICAL BELT SUPPORT APPARATUS

(75) Inventors: J. F. Barry Wood, Burlington, VT (US); R. William Hazelett, Colchester, VT (US)

(73) Assignee: Hazelett Strip Casting Corporation, Colchester, VT (US)

( * ) Notice: Subject to any disclaimer, the term of this patent is extended or adjusted under 35 U.S.C. 154(b) by 0 days.

(21) Appl. No.: 11/253,992

(22) Filed: Oct. 19, 2005

(51) Int. Cl.
*B22D 11/06* (2006.01)

(52) U.S. Cl. ..... 164/431; 164/481

(58) Field of Classification Search ..... 164/481–482, 164/431–433
See application file for complete search history.

(56) References Cited

U.S. PATENT DOCUMENTS

| | | | | |
|---|---|---|---|---|
| 3,123,874 | A | | 3/1964 | Hazelett et al. |
| 3,878,883 | A | | 4/1975 | Hazelett et al. |
| 3,933,193 | A | | 1/1976 | Baker et al. |
| 3,937,270 | A | | 2/1976 | Hazelett et al. |
| 3,949,805 | A | | 4/1976 | Hazelett et al. |
| 3,963,068 | A | | 6/1976 | Hazelett et al. |
| 4,061,177 | A | | 12/1977 | Sivilotti |
| 4,061,178 | A | | 12/1977 | Sivilotti et al. |
| 4,537,243 | A | | 8/1985 | Hazelett et al. |
| 4,901,785 | A | | 2/1990 | Dykes et al. |
| 4,940,076 | A | | 7/1990 | Desautels et al. |
| 5,477,912 | A | * | 12/1995 | Cisko et al. ..... 164/481 |
| 5,728,036 | A | | 3/1998 | Kagan et al. |
| 5,967,223 | A | | 10/1999 | Kagan et al. |
| 6,026,887 | A | | 2/2000 | Dykes et al. |
| 6,386,267 | B1 | | 5/2002 | Kagan |
| 6,575,226 | B1 | | 6/2003 | Kagan |
| 6,755,236 | B1 | | 6/2004 | Sivilotti et al. |

* cited by examiner

*Primary Examiner*—Kuang Y. Lin
(74) *Attorney, Agent, or Firm*—McCormick, Paulding & Huber LLP

(57) ABSTRACT

An apparatus for guiding a moving, flexible, tensed casting belt on a continuous metal casting machine along a substantially oval path. The continuous metal casting machine having an entrance-end, an exit-end and a moving-mold casting region extending from the entrance-end to the exit-end. The apparatus includes a non-rotating fluid pillow structure at the entrance end of the machine. The fluid pillow structure supports the mold-width of the casting belt. The apparatus includes two narrow shoulder-pulleys at the entrance end of the casting machine which are adjacent to opposite sides of the entrance-end fluid-pillow structure. Each pulley supports a portion of the belt outside of the moving-mold casting region. Each pulley guides the belt around the fluid-pillow structure as the belt revolves along its substantially oval path. The apparatus also facilitates the sealing, controlled-venting and recovery of pressurized fluids used to levitate the belt about a fluid-pillow structure.

7 Claims, 8 Drawing Sheets

View into Caster Entrance End

APPARATUS FOR STEERING CASTING BELTS OF CONTINUOUS METAL-CASTING MACHINES EQUIPPED WITH NON-ROTATING, LEVITATING, SEMI-CYLINDRICAL BELT SUPPORT APPARATUS

FIELD OF THE INVENTION

The present invention relates generally to a continuous molten-metal casting machine having an essentially straight or flat moving mold cavity or mold space provided by an endless casting belt or belts that must be steered, guided or directed from an entrance-end of the casting machine, and into and along a mold space or casting region, to an exit therefrom. The invention relates specifically to the steering, guiding or directing of endless metallic casting belts on casting machines equipped with non-rotating, belt-levitating, semi-cylindrical belt support structures at the entrance of the casting machine.

BACKGROUND OF THE INVENTION

Twin-belt continuous-casting machines used to cast molten metal employ upper and lower endless casting belts which are relatively thin and wide. The casting belts are formed of suitable, heat-conductive, flexible, metallic material as known in the art. The upper and lower casting belts are each revolved under high tension around a respective belt carriage in a substantially oval path. The revolving upper and lower belts define a moving-mold casting region. The casting region is formed between the nominally flat casting belts traveling from the entrance of the casting machine into the casting region to the exit therefrom. Thus, the casting region extends from the entrance to the exit end of a continuous molten-metal casting machine along an ostensibly flat casting plane.

While revolving in its substantially oval path, each casting belt is in direct and intimate contact with and is continuously passed around an entrance-pulley drum and an exit-pulley drum, that are relative to the entrance and exit of the casting region. Alternatively, each casting belt may be passed around the combination of an entrance non-rotating, belt-levitating semi-cylindrical belt-support apparatus and an exit-pulley drum. The non-rotating, belt-levitating semi-cylindrical belt-support apparatus typically employs pressurized air or other fluid to float or "levitate" a casting belt allowing it to move along the stationary apparatus and revolve in its substantially oval path. The pressurized fluid is emitted from a semi-cylindrical, fluid-pillow shell that levitates the casting belt and facilitates its rotation. This apparatus and method is described in U.S. Pat. Nos. 6,386,267 and 6,575,226 respectively, hereby incorporated by reference in their entirety.

The combination of a non-rotating, belt-levitating cylindrical belt-support apparatus and an exit-pulley drum provides several advantages. The use of such a combination provides additional space within the caster which may be utilized for improved cooling, support and stabilization of the casting belts. With either combination, however, the casting belts must be tensed, guided or steered, and in some cases, preheated before entering the casting portion of the mold. These functions are discussed in greater detail below.

Casting belts are typically tensioned by moving the exit-pulley drum of the caster. Each casting belt is under significant and uniform tension across the full width of the moving mold casting region. Tensioning is generally accomplished by moving the exit-pulley drum in a direction horizontal or parallel to the casting plane.

In addition to being tensioned, both the upper and lower belts also must be steered or guided. As the caster belts revolve during caster operation, they tend to move laterally in an unpredictable manner. Caster belt steering is the inducing of an intentional transverse movement in a desired direction in order to achieve or maintain optimal tracking of the casting belt during molten metal casting. The belts cannot be steered or guided, however, by confining their lateral movement through edge guidance efforts. The lateral motion of the highly-tensioned belts around a pulley involves such large sideways or edgewise forces that an edge of a revolving belt would distort, crumple and tear against a movement-restricting edge guide.

Hence, traditionally, with the belt in direct contact with each pulley perimeter surface, the belt is steered or guided by slightly tilting the axis of rotation of the exit-pulley drum. The axis of rotation of an exit pulley drum is tilted or skewed either horizontally or vertically (or combination thereof) relative to the plane of the casting region of the belt being steered. Steering the belt by employing vertical tilting is the most effective. Horizontal and vertical tilt steering are described in greater detail below and in U.S. Pat. No. 4,901,785 which is hereby incorporated by reference in its entirety.

The horizontal-tilting, or horizontal-skew, of the axis of rotation of an exit pulley drum serves to create a very-small leading-angle in relation to the axis of rotation of the exit-pulley drum. This small leading-angle causes the belt to approach the exit pulley drum in the desired lateral-direction for controlled horizontal skew belt steering. The progress of the belt in the lateral direction on the exit-pulley drum also creates a small leading-angle of the belt return loop in relation to the axis of rotation of the entrance pulley(s) resulting in a similar controlled horizontal skew belt steering at the entrance pulley(s).

The vertical-tilting, or vertical-skew, of the axis of rotation of an exit pulley drum serves to create a very small leading-angle of the belt in relation to the axis of rotation of the exit pulley drum. Simultaneously, an associated small leading-angle of the belt is created in relation to the axis of rotation of the entrance pulley drum. In other words for vertical-skew steering of a traditional caster, the belt wraps on both the entrance pulley and exit pulleys at an angle to the plane of the pulley rotation equal to the angle of vertical offset of the exit pulley in relation to the entrance pulley.

However, substituting a non-rotating, levitating, fluid-pillow belt-support apparatus for the entrance-pulley directly interferes with both belt steering concepts. The adverse impact to entrance-end fluid-pillow caster-belt steering control derives from the absence of direct, or intimate, contact of the highly-tensed caster belt to the perimeter surface of a rotating belt support structure. As such, without direct-contact of the caster-belt to a rotating entrance-pulley surface, horizontal-skew side-to-side force-differential steering and vertical-skew lead-angle steering cannot precisely control the belt tracking.

Thus, the creative integration of narrower shoulder-pulleys into the fluid-pillow design allows for the significant advantages for both fluid-pillows and caster-steering pulleys to be realized without compromising standard belt steering capabilities.

In addition, casting belts are often preheated to ensure casting of uniformly high-quality product. Preheating a casting belt before entering the mold reduces thermally induced strains in the belt, thereby assisting in keeping the belt flat during casting. Flat belts protect the solidifying molten metal being cast from unpredictable belt distortions caused by the high temperature casting. Belt preheating is disclosed in U.S. Pat. No. 4,537,243, which is hereby incorporated by reference in its entirety.

In casters employing non-rotating, semi-cylindrical, fluid-pillow belt-support apparatus, it is feasible to both support and preheat the belt through the use of an elevated temperature pressurized fluid, e.g., air, water or steam. To safely accomplish these functions, it is important to have effective edge sealing and controlled venting of the hot pressurized fluid. Typically, the hot pressurized fluid is vented to the ambient environment. Ideally, however, the hot fluid is entrapped and contained so that it may be recovered and potentially recycled rather than vented to the surrounding environment.

In light of the above, a need exists for an effective belt steering or guiding system for a caster equipped with a non-rotating, belt-levitating semi-cylindrical belt-support apparatus at the front-end of the mold. Likewise, a need exists for a system to effectively entrap and contain hot pressurized fluid so that it may be recovered and potentially recycled. The present invention of employing rotating shoulder pulleys in combination with non-rotating belt-levitating fluid-mold entrance belt-support structures facilitates our continuing need to employ belt preheat and fulfills these requirements.

SUMMARY OF THE INVENTION

An object of the present invention is to provide an improved apparatus and method for effectively guiding a casting belt on a continuous molten metal casting machine employing non-rotating, levitating, semi-cylindrical fluid-pillow belt support apparatus at the entrance of a casting machine by providing a narrow shoulder-pulley apparatus adjacent to each side of the fluid-pillow support structure.

Yet another object of the present invention is to provide an apparatus and method that facilitates the edge-sealing of pressurized fluids used to support a casting belt in a caster equipped with a non-rotating, levitating, semi-cylindrical fluid-pillow belt support.

A further object of the present invention is to provide an apparatus and method that facilitates the controlled venting of pressurized fluids used to support a casting belt in a caster equipped with a non-rotating, levitating, semi-cylindrical fluid-pillow belt support.

An additional object of the present invention is to provide an apparatus and method to facilitate the need to preheat casting belts on a continuous molten metal casting machine equipped with a non-rotating, levitating, semi-cylindrical fluid-pillow belt support apparatus which employs heated pressurized fluids for belt-support at the entrance of the caster.

Another object of the present invention is to provide an apparatus and method that can facilitate the potential recovery of heated pressurized fluids used to preheat and support a casting belt in a caster equipped with a non-rotating, levitating, semi-cylindrical fluid-pillow belt support.

An embodiment of the present invention includes an apparatus and method for guiding a moving, flexible, tensed casting belt on a continuous metal casting machine along a substantially oval path. The continuous metal casting machine having an entrance end, an exit end and a moving mold casting region extending from the entrance end to the exit end. The apparatus and method also includes a belt-support structure at each of the entrance and exit ends of the casting machine. The apparatus and method includes a non-rotating, levitating, semi-cylindrical fluid-pillow belt support structure, covering the maximum width of the casting portion of belt at the entrance-end of the casting machine. The fluid-pillow includes a narrow shoulder pulley adjacent to each side of the fluid pillow. Each narrow shoulder pulley supports a portion of the casting belt having a width substantially less than the width of the portion supported by the fluid-pillow belt-support structure the narrow shoulder-pulley working in unison with the exit steering pulleys to maintain the lateral position of the casting belts.

These and other objects, aspects, features, and advantages of the present invention will become more fully understood in light of the drawings and detailed description of the present invention provided below.

DETAILED DESCRIPTION OF A PREFERRED EMBODIMENT OF THE PRESENT INVENTION

Continuous molten metal casting machines are described Hazelett U.S. Pat. Nos. 3,123,874, 3,937,270 and 4,901,785, which are hereby incorporated by reference in their entirety. These machines are twin-belt casters that confine the freezing metal product on all sides. Some casting machines, however, use only one casting belt, revolving around one carriage. The description will proceed with respect to twin-belt continuous metal casting machines with the understanding that the invention is applicable to single belt casters as well.

In addition, this application describes casting machines which have a substantially-horizontal, or nearly so, molten-metal casting-angle. However, this invention applies to all casting machines using any casting angle.

Finally, as used herein, the terms "cylindrical" and "semi-cylindrical" are intended to be broadly construed so as to include a structure that has a cylindrical surface having a substantially-circular, or a substantially-convex, curvature. The terms may also include the integration of a taper at the entrance-end of the caster.

Figure 1:
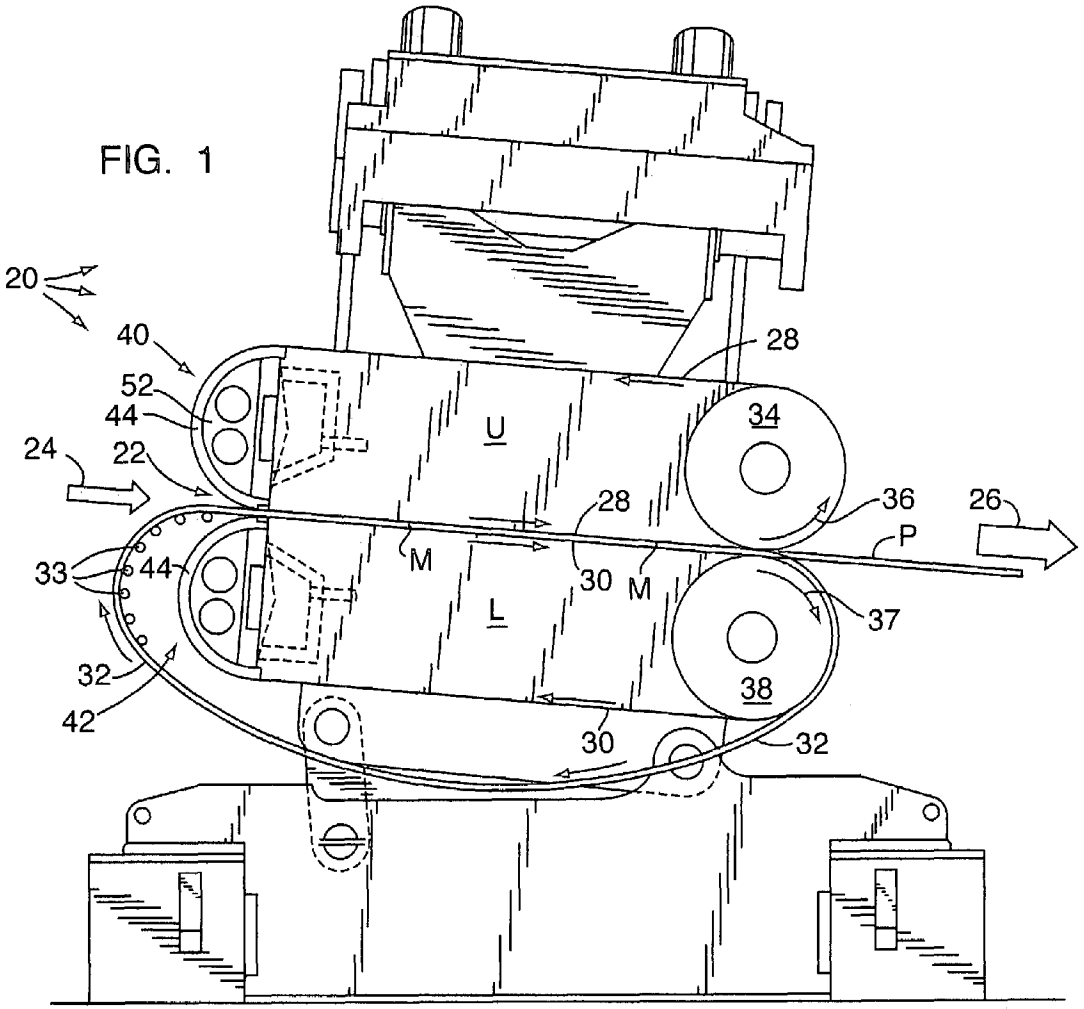
FIG. 1 is a side view of a prior art continuous molten metal caster equipped with a non-rotating, semi-cylindrical, fluid-pillow belt support structure providing an example of the type of caster in which the present invention can be employed to an advantage.

Turning now to FIG. 1, a twin-belt casting machine 20 equipped with an upper and lower non-rotating, levitating, semi-cylindrical fluid-pillow belt support apparatus 40, 42 is shown. As mentioned above, the fluid-pillow 40 is a type of belt support apparatus that involves applying pressurized fluid against a cylindrically curved inner surface of a casting belt to levitate the casting belt. The belt support apparatus 40, 42 includes fluid-pillow shells 44. The lower and upper carriages are indicated as L and U. Through molten-metal feeding equipment (not shown) known in the art, molten metal is introduced into the entrance end 22 of the moving mold cavity M. This introduction of molten metal is schematically indicated by a large open arrow 24 shown at the left. A continuously cast product P shown at the right in FIG. 1 emerges (arrow 26) from the exit end of the moving mold cavity M.

The lower and upper sides of the moving mold cavity M are bounded by revolving upper and lower endless, flexible, thin-gauge, metallic, heat-conducting casting belts 28 and 30 respectively. These belts 28, 30 are cooled on their inner surface by fast-moving liquid coolant, normally pressurized water. The two horizontal sides of the moving mold cavity M are bounded by two revolving edge dams 32 as known in the art. Still referring to FIG. 1, an edge dam 32 is shown guided into the entrance 22 by a crescent configuration of rollers 33. Upper belt 28 is driven (as shown by arrow 36) by a rotatably-driven upper exit pulley drum 34 positioned above the exit (downstream) end of the moving mold casting region or cavity M. Lower belt 30 and edge dams 32 are driven (as shown by arrow 37) by a rotatably-driven lower-exit pulley drum 38 positioned below the exit end of the moving mold cavity M. Further information regarding such twin-belt casting machines is set forth in the above-referenced patents.

Figure 2:
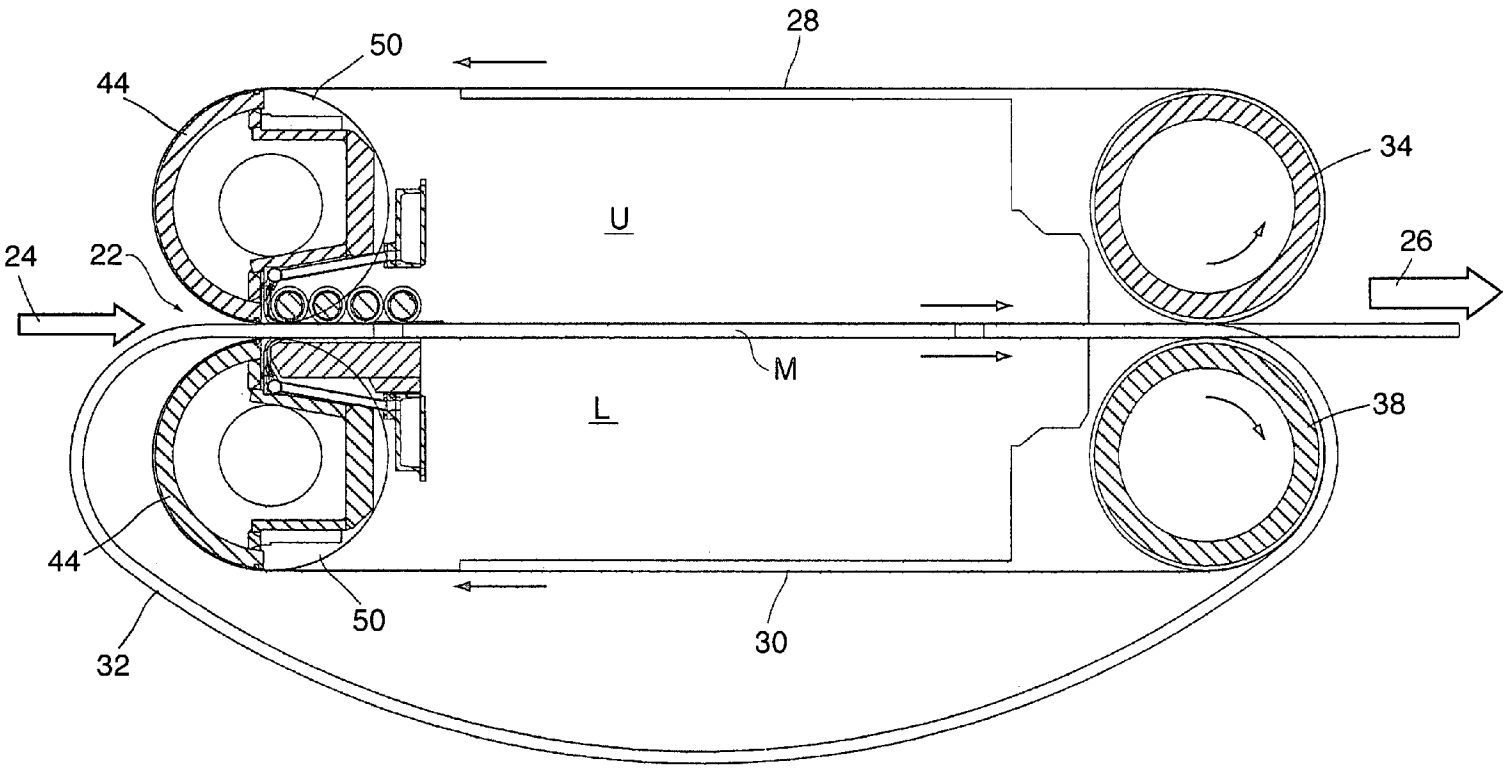
FIG. 2 is an enlarged, partially cut-away side view of the caster carriages of a molten metal caster illustrating the position of a fluid-pillow and a shoulder-pulley apparatus made in accordance with an embodiment of the present invention at the entrance end of both the upper and lower caster carriages.

FIG. 2 depicts the type of twin-belt casting machine illustrated in FIG. 1 equipped with a narrow shoulder-pulley apparatus 50 of the present invention. The shoulder-pulley apparatus 50 is located at the entrance/upstream end 22 of both the upper caster carriage U, and at the entrance/upstream end of the lower caster carriage L adjacent the fluid-pillow shells 44. The arrow 24 shows the direction of the molten-metal flow into the casting machine from a metal-feeding system (not shown), and arrow 26 depicts the direction of the solidified metal flow as it exits the casting machine at the downstream or exit end. Other unnumbered arrows depict the direction of travel of each casting belt 28, 30 for each caster carriage U, L as the belt 28, 30 travels from upstream end to downstream end in the moving mold cavity M, as well as, and equally important, the return-loop travel of each casting belt 28, 30 toward the shoulder-pulley apparatus 50 at the upstream end of each carriage.

Figure 3:
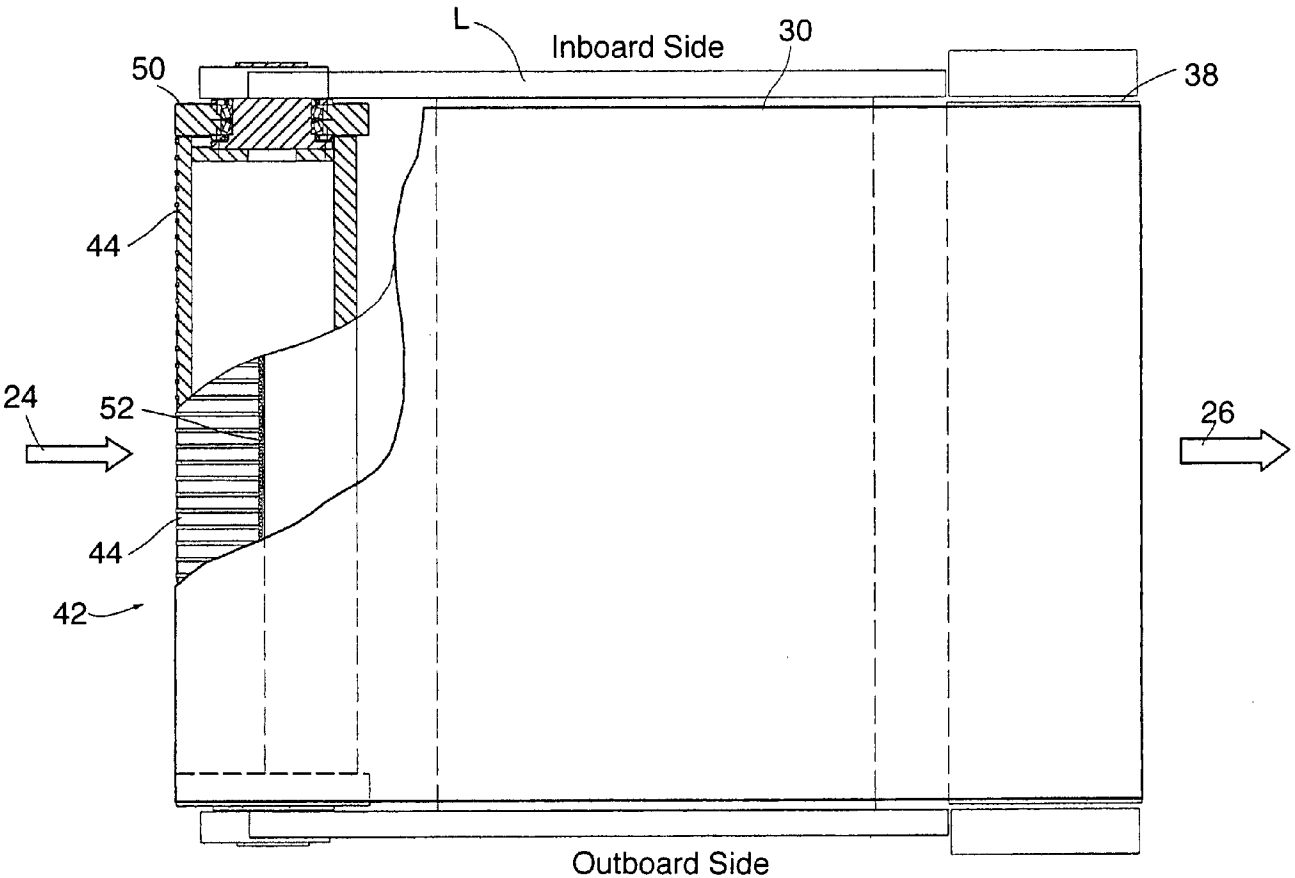
FIG. 3 is an enlarged top view of the lower caster carriage of FIG. 2, with the casting belt partially cut-away to reveal the fluid-pillow and one shoulder-pulley assembly.

Referring now to FIG. 3, each narrow shoulder-pulley apparatus 50 is rigidly and accurately mounted with roller bearings on the horizontal axis of the pillow shell 44. One shoulder-pulley 50 is located at the edge of the inboard side of the semi-cylindrical pressurized fluid-pillow shell 44 and another shoulder-pulley at the outboard edge of the fluid-pillow shell 44 to form a symmetrical casting belt support/tensioning/steering system which will be described later. The width of the fluid-pillow matches the maximum width of the casting mold. Each shoulder-pulley assembly 50 is totally enclosed, sealed, and lubricated to maintain a necessary and accurate relationship with their respective fluid-pillow assembly 42 over many hours of casting machine operation. Moreover, the axis of rotation of the shoulder-pulleys 50 is substantially the same as the axis of curvature of the semi-cylindrical fluid-pillow 44.

An important aspect of the present invention is the location of the shoulder-pulley assemblies at the edges of the fluid-pillow shell and the alignment of their axes with the curvature of the fluid-pillow. This configuration allows the active molten metal casting region of the belt to be frictionlessly levitated by the fluid-pillow shell, while the non-casting regions of the casting belt are supported by the narrow shoulder-pulleys which are utilized to apply the forces for steering or guiding the belt.

Figure 4:
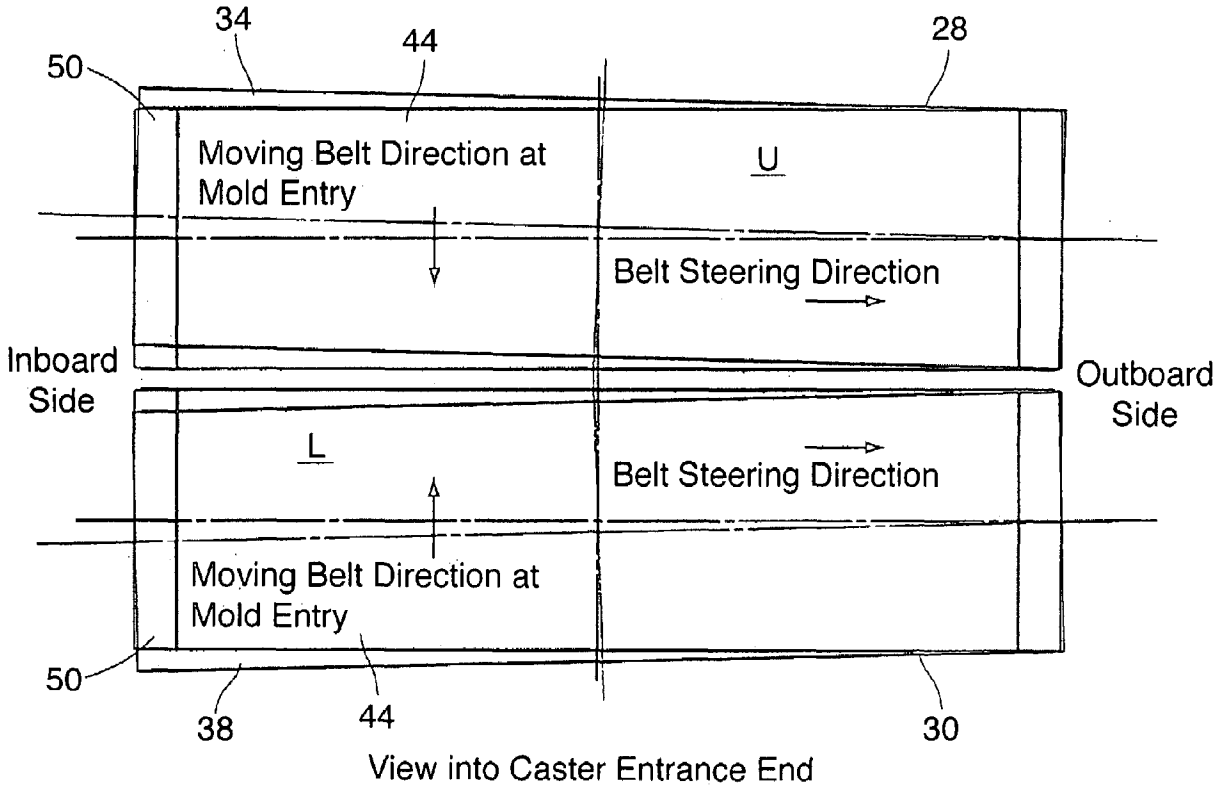
FIG. 4 is an enlarged view of the upper and lower caster carriages of FIG. 2 from the upstream or entrance end into the mold entrance illustrating the steering or guiding of the casting belts by the vertical skew of an exit-pulley drum.

FIG. 4 depicts the belt steering or guiding of the casting belts 28, 30 through the vertical skew of the upper and lower exit-pulley drums 34, 38, respectively. The solid bold horizontal outline shows the upper and lower entry shoulder pulley and fluid-pillow assemblies 50, 44 in their master reference positions, with axes horizontal. The vertical arrows show the direction of caster-belt rotation for both carriages. The angled outline shows the upper and lower downstream exit-pulley drums 34, 38 in one of the casting belt steering positions, with horizontal axes tilted from the horizontal. It is important to note that the angle of tilt for purposes of belt steering is typically very small. FIG. 4 exaggerates the tilt angle for purposes of illustration. When the downstream exit-pulley drums 34, 38 are vertically skewed as shown, the casting belts 28, 30 will track and steer or guide to the right, or outboard, side of the casting machine. This type of steering is discussed in U.S. Pat. Nos. 4,901,785 and 6,026,887, hereby incorporated by reference in their entirety.

Figure 5:
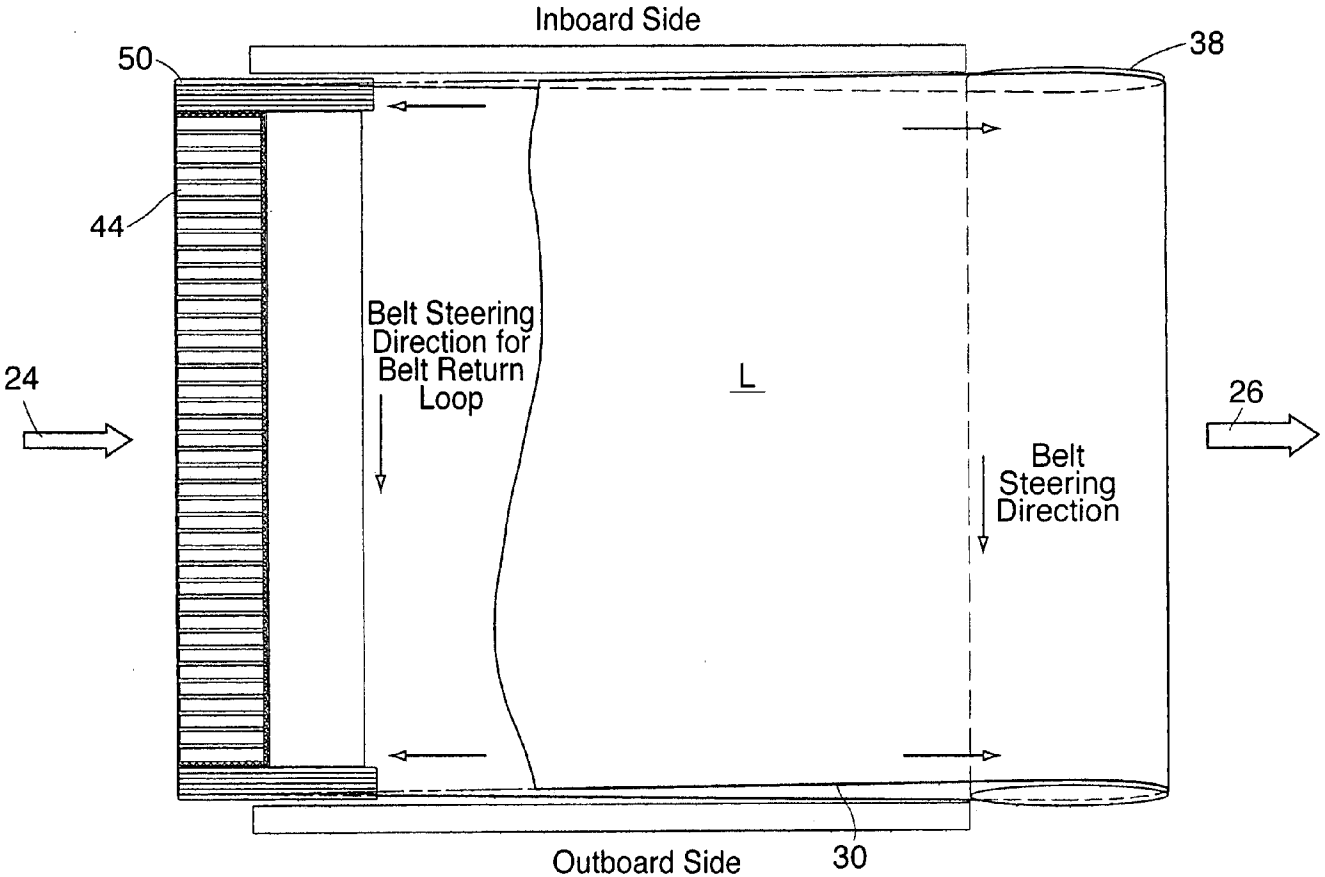
FIG. 5 is an enlarged, top view of the bottom caster carriage of FIG. 4, with the casting belt partially cut-away illustrating the placement of the shoulder-pulley apparatus and the steering or guiding of a casting belt by the vertical skew of the exit-pulley drum.

Referring now to FIG. 5, the bottom exit-pulley drum 38 is skewed in the same direction as shown in FIG. 4. This figure illustrates more dearly the casting belt 30 tracking/steering behavior in the transverse direction, as shown, toward the lower carriage L outboard side. As the moving-mold region of the casting belt 30 wraps onto the exit-pulley drum 38, the angle of approach of the casting belt 30 onto the exit-pulley drum 38 causes the casting belt 30 to track slowly toward one-side, here the outboard side, of the carriage L.

In a preferred embodiment, the shoulder-pulleys 50 are freely rotating. Additionally, the perimeter face of each shoulder-pulley 50 is optionally covered with at least a 70 Shore-A durometer scale elastomer which provides a small amount of compliance to facilitate the belt steering or guiding. More particularly, the elastomer equalizes belt tension thereby guiding the casting belt to maintain optimal belt tracking. The elastomer also assists in containing the pressurized fluid through improved sealing.

Figure 5A:
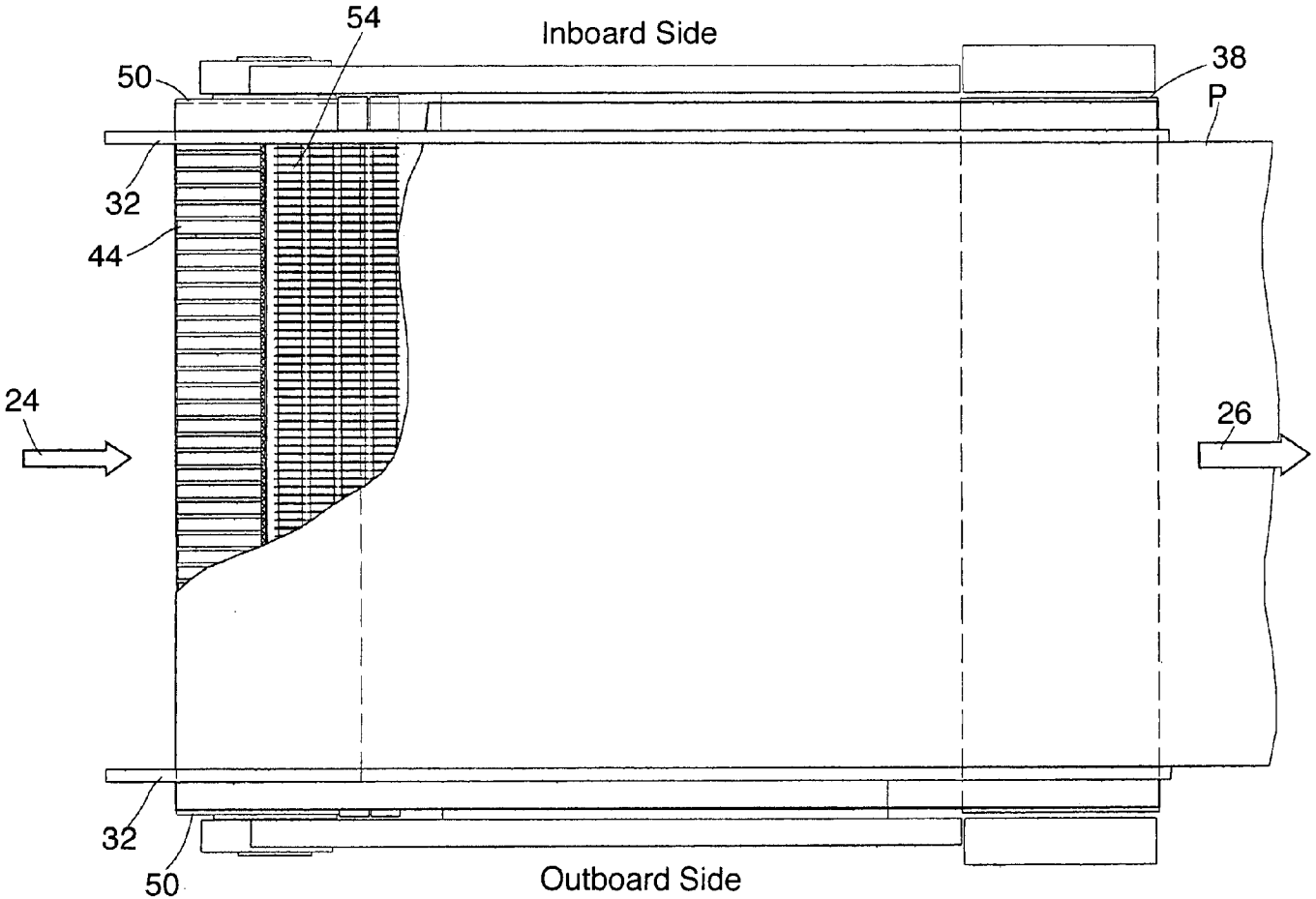
FIG. 5A is an enlarged, top view of the lower carriage of FIG. 2, with the casting belt partially cut-away to depict the use of cast width magnetic backup rolls and their placement between the shoulder-pulley assemblies.

FIG. 5A illustrates the placement of the shoulder-pulley assemblies 50 with regard to the fluid-pillow shell 44. The assemblies 50 are located on opposite ends or sides of the shell 44, i.e., at the inboard and outboard edges of the shell 44, allowing magnetic back-up rolls 54 to be placed in the space between the assemblies 50. This configuration is an important aspect of the present invention in that magnetic back-up rolls provide support and stabilization of a casting belt across the maximum cast-width moving-mold surface or region of the casting belt thereby preventing thermal distortions in the casting belts. The function and use of such back-up rolls is disclosed in U.S. Pat. No. 5,728,036, hereby incorporated by reference in its entirety.

As mentioned above, the shoulder-pulleys of the present invention also provide effective edge sealing, entrapment and controlled venting of the pressurized fluid used to levitate and, ideally, heat the casting belt. This functionality is illustrated in FIGS. 5B, 6, 6A and 6B which are discussed in greater detail below.

Figure 5B:
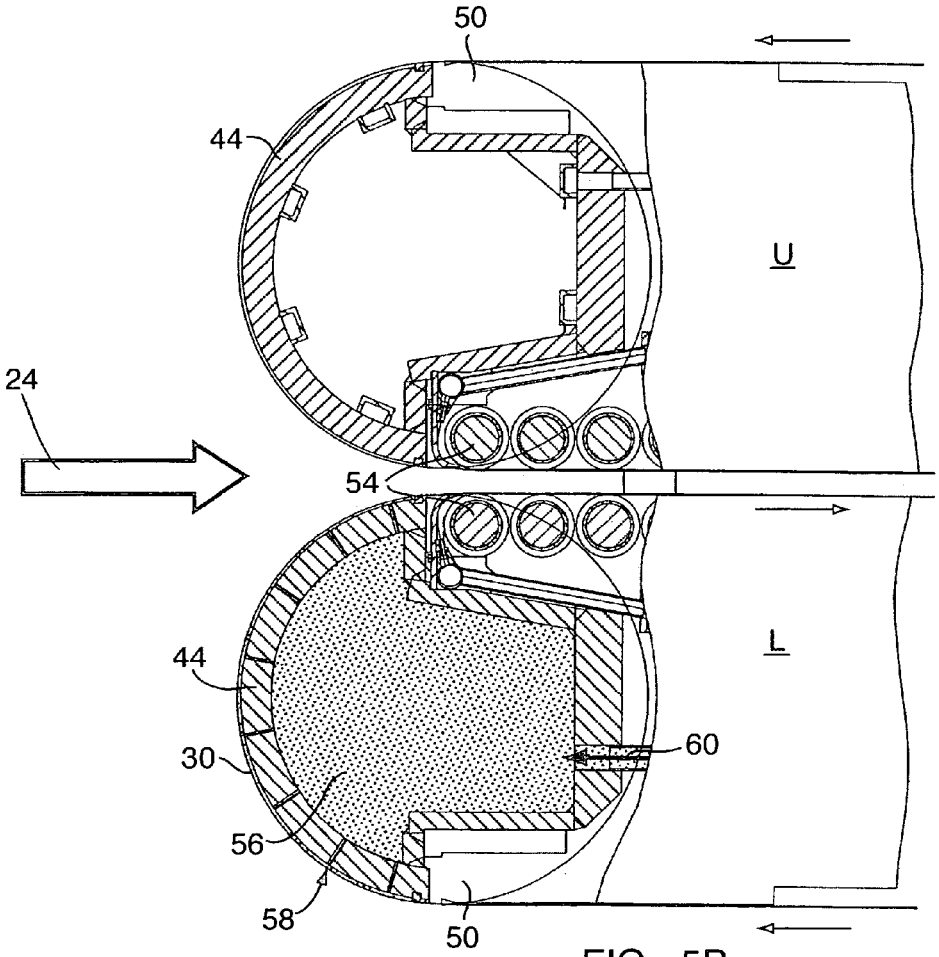
FIG. 5B is an enlarged, side view of the upper and lower carriages of FIG. 2, cut-away to illustrate in greater detail the fluid-pillow shells, shoulder-pulley assemblies and magnetic backup rolls at the entry end of the lower and lower carriages.
Figure 6:
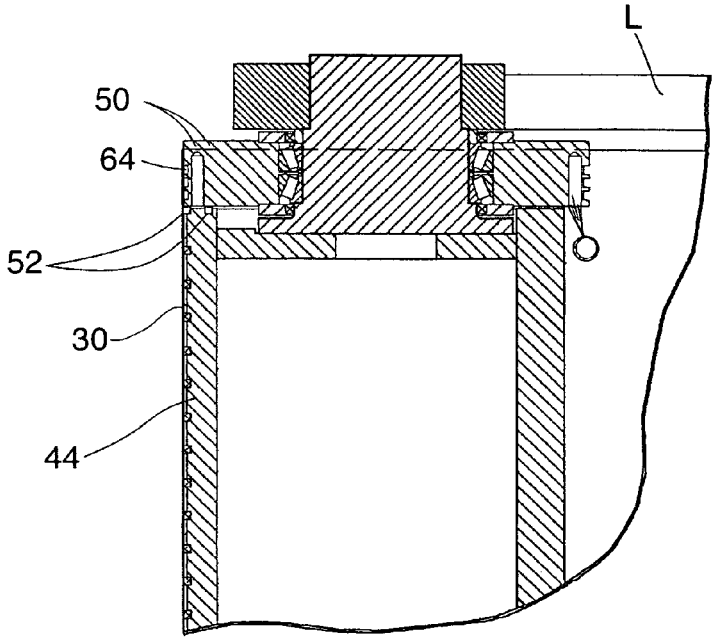
FIG. 6 is an enlarged top view of the shoulder-pulley apparatus of FIG. 3 cut-away to provide greater detail of the assembly including the perimeter seals and related structure.
Figure 6A:
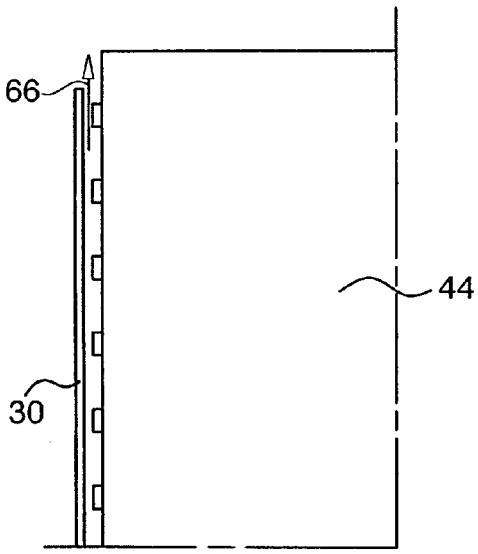
FIG. 6A Prior Art
FIG. 6A is a cross-sectional diagram of a prior art pressurized fluid-pillow casting belt support structure illustrating the levitation of a casting belt and the practice of venting of the pressurized fluids to the ambient environment.
Figure 6B:
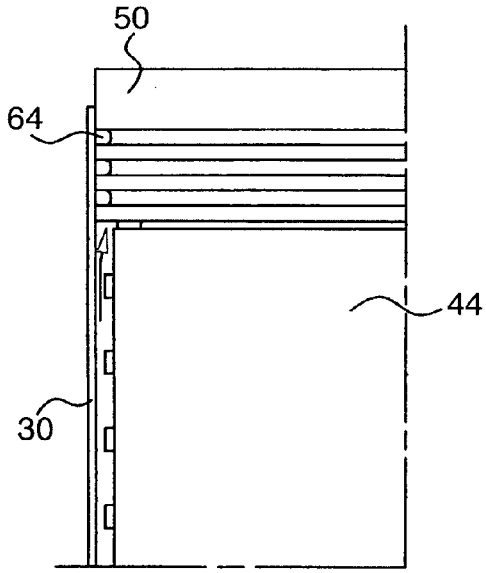
FIG. 6B is a cross-sectional diagram of a pressurized fluid-pillow casting-belt support structure modified with a shoulder-pulley assembly made in accordance with an embodiment of the present invention illustrating how the shoulder-pulley apparatus facilitates the entrapment of the pressurized fluids.

FIG. 5B depicts the fluid-pillow shells 44, shoulder-pulleys 50 and magnetic back-up rolls 54. Referring to the lower carriage L, pressurized fluid is introduced into the inner cavity 56 of the fluid-pillow shell as indicated by arrow 60. The pressurized fluid is then ported through nozzles 58 into the space between the casting belt 30 and the external surface of the fluid-pillow shell 44. The pressurized fluid thereby levitates the casting belt 30 on the shell 44. As mentioned above, an important aspect of the present invention is the sealing of the pressurized fluid. The pressurized fluid is ideally used for preheating the belts, in addition to levitating them, and is therefore hot. The shoulder-pulleys 50 of the present invention facilitate the capture, controlled venting and potential recycling of the hot, highly pressurized fluid as opposed to simply venting the fluid to the ambient environment. FIGS. 6, 6A and 6B provide additional detail on how this is accomplished.

Turning to FIG. 6, the shoulder-pulley 50 is in fluid communication with the fluid-pillow 44 and forms a perimeter or edge seal 52 against the pillow 44. The edge seal 52 is located on the perimeter of the shoulder-pulley 50 and prevents the escape of the pressurized fluid that is used to levitate the belt 30. As will be appreciated, the performance of these perimeter seals 52 is important for reliable operation of the casting machine, especially if pressurized hot air, pressurized hot water, steam or other fluid is to be used not only for casting-belt levitation, but also for casting-belt preheating prior to the belt entering the caster-mold region.

Additionally, the shoulder-pulley 50 may have grooves 64 extending along the circumference of its perimeter surface or face, to vent the pressurized fluids in a controlled fashion. This reduces the amount of heat into and resulting thermal expansion of the shoulder-pulleys, due to the requirement for preheating the full width of the casting belt. Additionally, internal water-cooling of the shoulder-pulley assemblies 50 can be used to reduce the shoulder-pulley operating temperature when utilizing casting-belt preheating.

Referring to FIG. 6A, in prior art fluid-pillow shells 44 the pressurized fluid is vented unfettered to the ambient environment as indicated by arrow 66. FIG. 6B, however, depicts a shoulder-pulley 50 of the present invention and illustrates how the shoulder-pulley 50 seals and controllably vents the pressurized fluid. As in FIG. 6, the extreme outer surface of the shoulder-pulley has been modified with sealing pathways, or grooved shoulder-pulley surfaces 64, to restrict the pressurized fluids and prevent their uncontrolled escape from the system.

As such, the shoulder-pulley 50 provides a controlled, pressurized-fluid sealing, or venting, function for the fluid used for belt levitation, pressurized-fluid control, potential belt preheating and possible pressurized-fluid recovery purposes. Optionally, the perimeter of the shoulder-pulleys 50 is covered with a minimum 70 Shore-A durometer scale elastomer which assists in containing the pressurized fluid for sealing.

As will be appreciated by consideration of the embodiments illustrated in FIGS. 1–6B, the present invention provides a shoulder-pulley apparatus 50 which, in connection with vertical skew steering of an exit-drum pulley 34, 38, guides or steers a casting belt 28, 30 on a continuous molten metal caster 20 equipped with a semi-cylindrical, belt-levitating, fluid-pillow shell 44. The shoulder-pulley apparatus 50 also may be designed to form an edge-seal 52 which restricts the escape of the pressurized fluid used to levitate the casting belt 28, 30 on the fluid-pillow shell 44. Moreover, the formation of grooves or pathways 64 in the perimeter face of the shoulder-pulleys 50 allows the pressurized fluid, which may also be heated, to be vented in a controlled manner and potentially recycled.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A casting system which comprising an apparatus for guiding a moving, flexible, tensed casting belt on a continuous metal casting machine along a substantially oval path, said continuous metal casting machine having an entrance end that receives molten metal, an exit end where the cast product exits the machine and a moving mold casting region extending from said entrance end to said exit end, said apparatus comprising:

a non-rotating, semi-cylindrical fluid-pillow at the entrance end of the casting machine, said fluid-pillow applying pressurized fluid against a cylindrically curved inner surface of the casting belt to levitate said casting belt, wherein said fluid is air, water or steam;

a pulley drum at the exit end of the casting machine that may be skewed vertically and horizontally relative to a plane of the casting belt in the moving mold casting region, wherein said vertical and horizontal skew of the pulley drum steers the casting belt;

a pair of narrow pulleys, each of which is outside of the moving mold casting region and is adjacent to opposite ends of the fluid-pillow at the entrance end of the casting machine, wherein the axis of rotation of each of said pulleys is substantially the same as the axis of curvature of the fluid-pillow, said pulleys guiding the casting belt; and wherein the steering of the pulley drum in cooperation with the belt guidance created by the narrow pulleys maintains optimal belt tracking of the casting belt as said belt revolves along its substantially oval path.

2. The apparatus of claim 1, wherein:

a perimeter of each narrow pulley is in fluid communication with and forms a seal against each end of the semi-cylindrical fluid-pillow, said seal preventing uncontrolled escape of pressurized fluid used to levitate the casting belt from the pillow.

3. The apparatus of claim 2, wherein:

each narrow pulley is in fluid communication with an end of the fluid-pillow, and the surface of each pulley that supports a portion of the casting belt includes at least one groove extending along the entire circumference of the pulley surface, said grooves providing controlled venting of pressurized fluid used to levitate the casting belt from the fluid-pillow.

4. The apparatus of claim 1, wherein:

the surface of each narrow pulley that supports a portion of the casting belt is coated with at least a 70 Shore-A durometer-scale elastomeric material, said elastomeric material equalizing belt tension thereby guiding the casting belt to maintain optimal belt tracking of the casting belt, said elastomeric material also assisting containing the pressurized fluid for sealing.

5. The apparatus of claim 2, wherein:

the air or water is heated.

6. The apparatus of claim 5, wherein:

each narrow pulley is in fluid communication with an end of the fluid-pillow, and the surface of each pulley that supports a portion of the casting belt includes at least one groove extending along the entire circumference of the pulley surface, said grooves facilitate the use and recovery of heated pressurized-water which levitates and pre-heats the casting belt.

7. The apparatus of claim 5, wherein:

the surface of the narrow pulleys that support a portion of the casting belt is coated with at least a 70 Shore-A durometer-scale elastomeric material, said elastomeric material equalizing belt tension thereby guiding the casting belt to maintain optimal belt tracking of the casting belt, said elastomeric material assisting in containing the heated pressurized fluid for sealing.

* * * * *